United States Patent [19]

McCormick et al.

[11] Patent Number: 4,817,934

[45] Date of Patent: Apr. 4, 1989

[54] DUAL TOTE SORTER AND STACKER

[75] Inventors: Walter A. McCormick, Bellevue; Douglas W. Langton, Seattle; James Kellum, Renton; Steve McKelvy, Bellevue; Greg Phillips, Seattle, all of Wash.

[73] Assignee: EMF Corporation, Redmond, Wash.

[21] Appl. No.: 78,254

[22] Filed: Jul. 27, 1987

[51] Int. Cl.[4] ..... B65H 39/10

[52] U.S. Cl. ..... 271/296; 271/186; 271/197; 271/201; 271/220; 271/236

[58] Field of Search ..... 271/278, 177, 178, 186, 271/197, 200, 201, 220, 251, 296, 236, 238, 239

[56] References Cited

U.S. PATENT DOCUMENTS

| | | | |
|---|---|---|---|
| Re. 27,976 | 4/1974 | Sahley | 355/64 |
| 3,166,313 | 8/1961 | Rehm | 271/86 |
| 3,356,362 | 12/1967 | Mestre | 271/296 X |
| 3,385,457 | 5/1968 | Zinn | 214/6 |
| 3,709,480 | 1/1973 | Schulze et al. | 270/58 |
| 3,774,906 | 11/1973 | Fagen et al. | 271/64 |
| 3,802,694 | 4/1974 | Post et al. | 270/58 |
| 3,841,754 | 10/1974 | Drexler et al. | 355/17 |
| 3,934,868 | 1/1976 | Selak | 271/9 |
| 3,937,459 | 2/1976 | Lawrence | 271/173 |
| 3,944,217 | 3/1976 | Greene et al. | 271/173 |
| 3,955,811 | 5/1976 | Gibson | 271/9 |
| 3,973,769 | 8/1976 | Cross et al. | 271/173 |
| 3,977,667 | 8/1976 | Cross et al. | 271/64 |
| 3,988,018 | 10/1976 | Tusso et al. | 271/173 |
| 3,990,695 | 11/1976 | Cross et al. | 271/64 |
| 4,046,371 | 9/1977 | Sevak | 271/178 |
| 4,047,472 | 9/1977 | Haberstroh | 93/93 D |
| 4,047,713 | 9/1977 | Snellman et al. | 271/221 |
| 4,070,015 | 1/1978 | Muka | 271/100 |
| 4,103,885 | 9/1977 | Fox | 271/117 |
| 4,157,822 | 6/1979 | Miller | 271/3.1 |
| 4,166,614 | 9/1979 | Hamlin et al. | 271/3.1 |
| 4,169,674 | 10/1979 | Russel | 355/14 |
| 4,176,945 | 12/1979 | Holzhauser | 355/23 |
| 4,179,215 | 12/1979 | Hage | 355/50 |
| 4,181,078 | 1/1980 | Davis | 101/426 |
| 4,204,727 | 5/1980 | Tates | 355/3 R |
| 4,221,379 | 9/1980 | Kamath et al. | 271/289 |
| 4,228,995 | 10/1980 | Breuers et al. | 271/292 |
| 4,238,126 | 12/1980 | Langdon | 271/3.1 |
| 4,248,525 | 2/1981 | Sterrett | 355/14 SH |
| 4,297,025 | 10/1981 | Bach et al. | 355/145 H |
| 4,315,621 | 2/1982 | Snellman | 271/296 |
| 4,333,641 | 6/1982 | Peter, III | 271/289 |
| 4,344,614 | 8/1982 | Kaneko et al. | 271/288 |
| 4,352,490 | 10/1982 | Hatakeyama | 271/289 |
| 4,359,219 | 11/1982 | Garavuso | 271/236 |
| 4,452,440 | 6/1984 | Fagen et al. | 271/3.1 |
| 4,469,323 | 9/1984 | Miyashita et al. | 271/288 |
| 4,496,143 | 1/1985 | Weyer | 271/112 |
| 4,498,665 | 2/1985 | Watanabe | 271/289 |
| 4,512,255 | 4/1985 | Crist | 101/230 |
| 4,515,458 | 5/1985 | Masuda et al. | 355/3 SH |
| 4,530,593 | 7/1985 | Kasuya et al. | 355/14 R |
| 4,578,582 | 3/1986 | Takano | 250/327.2 |
| 4,589,654 | 12/1983 | Kanoto | 271/314 |
| 4,624,452 | 11/1986 | Pulskamp | 270/95 |
| 4,667,809 | 5/1987 | Raybuck | 198/456 |
| 4,673,176 | 6/1987 | Schenk | 271/186 |

FOREIGN PATENT DOCUMENTS

| | | | |
|---|---|---|---|
| 1494325 | 12/1977 | United Kingdom | 15/58 |

*Primary Examiner*—Richard A. Schacher
*Attorney, Agent, or Firm*—Garrison & Stratton

[57] ABSTRACT

The present invention comprises a dual tote sorting and stacking apparatus for continuously transporting, sorting and stacking sequentially fed sheets of paper such as from printing, copying and duplicating machinery. The apparatus employs mass airflow type of conveyors for paper transport. A diverter is provided for selectively diverting the sheet to designated receiving trays or, optionally, for expelling the sheet from the apparatus. A jogger is provided for jogging the sheets which are deposited into the trays into individually aligned job stacks. An assembly may also be provided for flipping the sheets as they enter the apparatus or for feeding individual sequentially fed sheets into the apparatus.

16 Claims, 9 Drawing Sheets

DUAL TOTE SORTER AND STACKER

TECHNICAL FIELD

This invention relates to a sheet transport and stacking apparatus adapted to transport, sort and stack individually fed sheets into stacks on removable trays, bins or totes. More specifically, the present invention relates to apparatus which enable the uninterrupted transportation and stacking of sheets individually fed from a printer or copy machine. The apparatus includes a dual tote system, a jogging apparatus, a document flipper apparatus, a pass-through conveyor apparatus, and a slip-sheet feeder apparatus. The present invention is particularly well suited for use with high volume document printing and duplicating devices.

BACKGROUND ART

Within the printing and photocopying industries there has been a great need for various types of sheet handling equipment. Numerous inventions, created in an attempt to meet that need, have been disclosed in issued patents. Most disclosures use various configurations of conveyor belts, pinch rollers, deflector mechanisms, and input and output trays. Slight differences in the positioning and design of these features often dramatically change the effectiveness of the invention as a whole. At rapid operational speeds, less effective designs cause the sheets to become airborne, have excessive curl, generate static or become jammed within the machine. Significant factors contributing to this phenomenon are the flexibility and aerodynamic characteristics of the sheets of paper, and their susceptibility to the forces of static electricity.

Effective volume air flow sheet feed mechanism are shown in the prior art: Commonly assigned patents including Fagan et al. (U.S. Pat. No. 3,774,906), Greene et al. (U.S. Pat. No. 3,944,217), Fagan et al. (U.S. Pat. No. 4,452,440), and Weyer (U.S. Pat. No. 4,496,143) each show sheet handling, feeding and sorting devices using a mass airflow to hold document sheets onto a conveyor belt. Fagan et al. (U.S. Pat. No. 3,774,906) also discloses a sorter having a conveyor belt system whereupon the sheets travel from a feed source across the sorter, downwardly and are then deflected into one of several awaiting stationary, inclined trays to form books. Another stationary, inclined output tray is shown in Miller (U.S. Pat. No. 4,157,822). Langdon (U.S. Pat. No. 4,238,126) discloses a significantly different document flipper apparatus than that described and claimed herein. Fox (U.S. Pat. No. 4,103,885), Muka (U.S. Pat. No. 4,070,015), Hamlin et al. (U.S. Pat. No. 4,166,614), and Sahley (U.S. Pat. No. Re. 27,976) disclose various sheet feeders. Each of these patents show devices which are of interest only and do not show the concepts embodied in this invention.

DISCLOSURE OF INVENTION

It is a general object of the present invention to provide an apparatus capable of transporting and stacking sheets of paper from a printing or copying device on a high-speed, high-volume, continuous basis.

Another object is to provide an apparatus wherein each individual tray or tote is removable and capable of receiving a large quantity of stacked sheets.

A further object is to provide an apparatus wherein the trays and stacked sheets thereon may be removed from the apparatus without interrupting the stacking of incoming sheets.

A still further object is to provide an apparatus for jogging the sheets within the trays or totes into easily defined and separated job stacks.

Another object is to provide an apparatus for selectively flipping the sheets when they enter the apparatus.

One additional object is to provide an apparatus for selectively passing the sheets through the apparatus, to an adjacent sorter or stacker or to other sheet receiving devices such as a proof tray or the like.

The present invention allows the uninterrupted continuous stacking of large quantities of sheets. Individually fed sheets from a source such as a printer or copy machine, are introduced into the entrance opening of a cabinet or enclosure, housing the stacking apparatus. The sheets are either diverted toward a pass through conveyor or are urged into the sheet transfer zone of a vertical conveyor. The vertical conveyor moves the sheets downwardly, held against a foraminous conveyor belt assembly by volume air flow techniques as shown in the aforementioned Greene patent. A vacuum plenum is positioned between the upward and downward runs of the vertical conveyor belts. Conveyor belts are trained about upper and lower rollers and transport the sheets along the surface of the conveyor. A removal means including a pivotally mounted deflector is positioned for movement vertically between the conveyor belts and the vacuum plenum and when extended urges the sheets away from the vertical conveyor toward a sheet stacking tray or tote. The sheets are received and supported by a carriage means which directs the sheets toward the tray and deposits the sheets in the tray. If the deflector is pivoted out of the sheet path the sheets continue downwardly to a second deflector and carriage which directs the sheets toward a second tray and deposits the sheets upon the sheet receiving surface of the second tray.

The first and second trays are designed to support large quantities of stacked sheets. The first and second trays are easily removed one at a time from within the enclosure while the device is operating by opening an access door in the support frame and removing the tray not in use through the opening.

This apparatus may be operated to allow the continuous stacking of the sheets into either the first or second tray until that tray is full or has received the desired number of sheets, whereupon the deflector means is re-positioned, permitting the incoming sheets to travel toward the other tray. The tray which is full is removed from the enclosure. Due to the large capacity of both trays, sufficient time is allowed for the removal of the stack of sheets from the removed tray and for the replacement of the removed tray within the enclosure before the other tray becomes full. This procedure is repeated allowing the uninterrupted continuous stacking of large numbers of sheets. This procedure employs a "dual tote" system, and is advantageously employed in high speed continuous printing or copying operations wherein large numbers of sheets must be stacked in job-separated units. Multiple, interchangeable trays or totes may be used to facilitate switching from one tray to the other while the stacker is operating. As used herein the terms "tray" and "tote" are interchangeable, both meaning a removable, box-like platform on which the sheets are stacked.

To facilitate the jogging of the sheets into uniform stacks in the direction of sheet travel within the first and second trays, the receiving surfaces of the first and second trays are angled from horizontal. As the sheets are deposited, gravity and the momentum of the sheets causes the sheets to become aligned against a backstop or retaining wall of the tray and are thus passively positioned into a neat stack in the direction of sheet travel.

Where the receiving surfaces of the trays are angled from horizontal and the first conveyor belt assembly is vertically oriented, the distance between the successive heights of the stack and the discharge means which urges the sheets toward the trays is automatically compensated by the extension or contraction of the sheet support surfaces of the carriages. As the height of the stack of sheets increases, the length of the carriages is extended so that the point of discharge remains constant with respect to the stack of sheets being formed.

To insure the sheets are properly delivered to each tray, a positive drive mechanism is provided, wherein the sheets are fed between the nips of a set of powered pinch rollers which regulate the speed of the sheets as they are discharged and then deposited upon each stack. Controlling the speed of the sheets as described will regulate or eliminate rebound from the passive positioning surface or backstop.

In addition to the passive positioning mentioned above the present invention also uses a motor driven jogging apparatus to align the sides of the sheets. A flexible jogging finger, capable of jogging a single sheet on the top of a stack of sheets into a registered position, whereby the next lower sheet remains quiescent is provided. The flexible elastomeric finger of this jogger is passed across the top sheet of the stack of sheets in a gentle wiping motion, moving the top sheet until it of this jogger s passed across- the top sheet of the stack of sheets in a gentle wiping notion, moving the top sheet until it is aligned against a side wall. The jogging apparatus does not continually rotate: rather, it rotates one complete turn each time a sheet is fed on the stack and then awaits the deposit of the next sheet into the tray. The rotational axis of the flexible jogging finger preferably is not parallel to the receiving surface of the tray; rather the rotational axis is angled slightly downwardly from the angle in which the sheets enter upon the receiving surface of the tray. The use of a triangular, substantially prismatic-shaped flexible jogging finger has the unique ability, when properly positioned, to jog the sheets in two directions, namely against the backstop and against one side wall. If the rotational direction of the flexible jogging finger is reversed, the top sheet is jogged into alignment against the opposite side wall and the backstop. The side walls may be positioned at different locations on the receiving surface to accommodate different paper sizes. If the distance between side walls is greater than the length of the paper and the rotational direction of the flexible jogging finger is reversed after each job is completed, then the sheets are jogged into clearly defined and offset uniform job stacks.

Where the receiving surfaces are not angled from horizontal, or when it is desired to jog against a rear or front backstop with a motorized jogger, dual flexible jogging fingers rotating on axes which are perpendicular to one another may be used to jog the sheet in two directions: against the backstop wall, and 28 against either side wall of each tray.

The present invention may also be used with a sheet flipper apparatus having a flipper assembly which is capable of selectively inverting the sheets as they enter the enclosure, and thereby flipping the paper to reverse the sheets. In its preferred embodiment, the document flipper has a momentum absorbing and transferring means which gently absorbs the momentum of the sheet and transfers that momentum back to the sheet, thereby reversing the direction of travel of the sheet, after one edge of the sheet has cleared a transfer gate so that the sheet is inverted and then moved back into the paper path for transfer to the stacker. Due to the unique momentum transfer concept, sheets of various sizes can be inverted by this sheet flipper. Since the device is operated by the momentum of the sheet, with no additional forces required, it may operate independently of the sheet feed mechanism of the adjacent sheet source and needs no means to synchronize its operation with the adjacent sheet source or the stacker described herein.

A pass-through conveyor apparatus, which allows selected sheets to pass through the apparatus without being stacked within the trays, may also be used in the present invention. Where the sheets are directed toward the first path by the diverting means, the sheets are urged onto a sheet transfer section of a substantially horizontal conveyor belt assembly. The sheets are held against the substantially horizontal conveyor belt assembly by a light-weight pressure strap which presses against the conveyor belt assembly. The sheets are then transported to an exit opening and ejected from the apparatus into another sheet handling means, a proof tray or the like. This option may be automatically engaged where both trays are full. By using both the pass-through conveyor apparatus and the flipper apparatus, the sheets may be flipped and ejected from the apparatus to an adjacent sorter, stacker or other sheet handling device.

A slip-sheet feeder apparatus may also be attached to the apparatus to introduce individual sheets into the apparatus. This feature allows the insertion of a slip-sheet between each job stack or at other locations as desired. The feature also allows an original stack of sheets to be passed into the enclosure where the sheets may be sorted, jogged, and stacked into the removable trays.

BEST MODE FOR CARRYING OUT THE INVENTION

Figure 1:
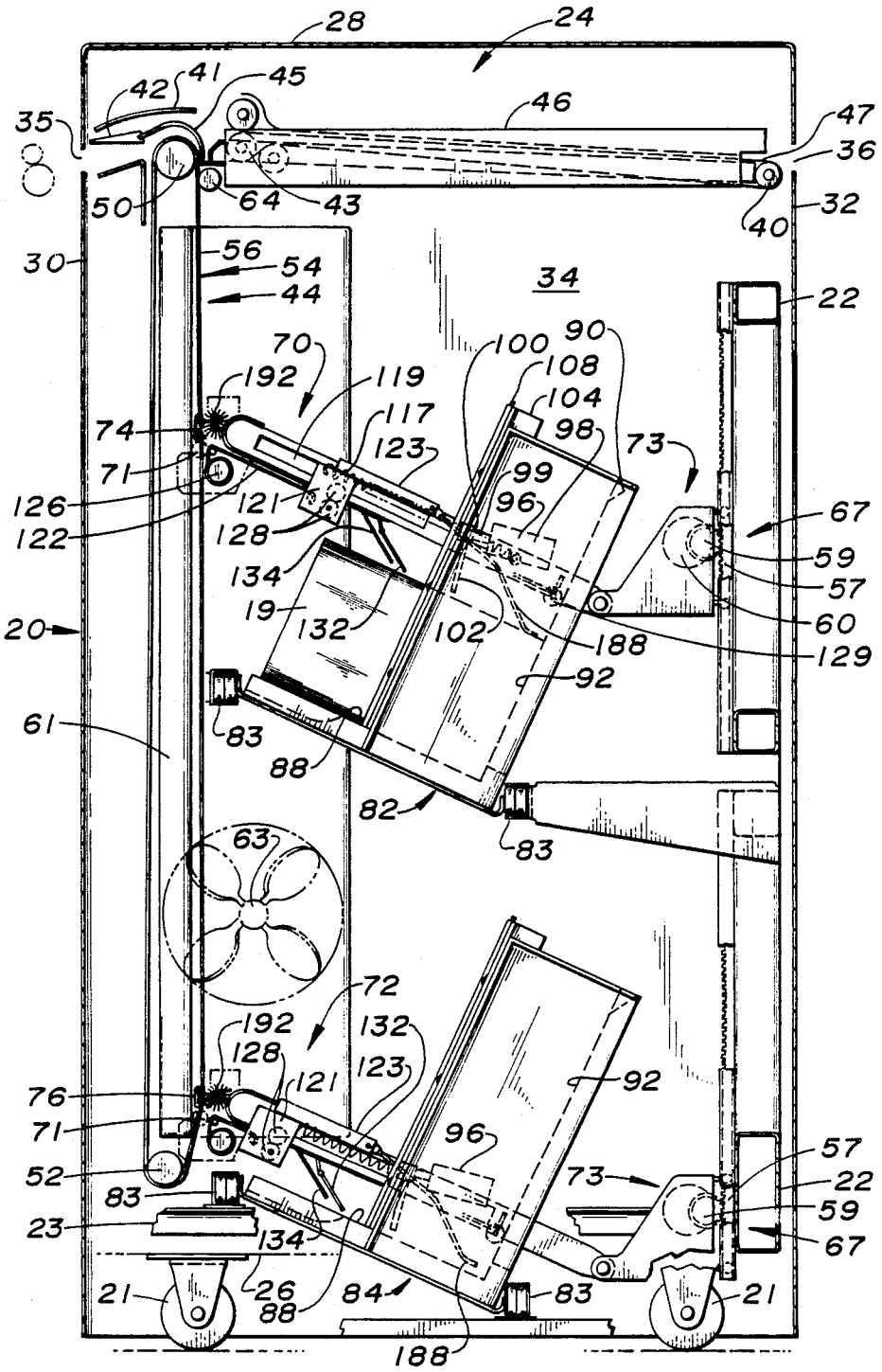
FIG. 1 is a side elevational view of one preferred embodiment of the dual tote stacker and pass-through conveyor apparatus made in accordance with this invention.

Referring to the drawings and particularly to FIG. 1, wherein like numerals indicate like parts, the sheet stacking apparatus 20 has an upstanding generally rectangular support frame 22. The support frame 22 defines an enclosure which has a base 26, a lid 28, an entrance wall 30, an exit wall 32, a front wall (not shown), and a back wall 34. An entrance opening 35, being an elongated rectangular slot through which sheets may enter the apparatus 20, is located near the top of the entrance wall 30. An exit opening 36, being an elongated rectangular slot through which the sheets of paper may exit the apparatus 20, is located near the top of the exit wall 32. The support frame 22 may sit directly upon the floor, sit upon leveling pedestals, or sit upon caster wheels 21. If rolling casters are used, the apparatus 20 should be secured to the feeding apparatus, such as a printing or duplicating device, to insure the proper feeding of the sheets into the entrance opening 35.

Upon entering the apparatus 20, the sheets may be transferred horizontally across the top of the stacker and out the opening 36, or may be sorted, stacked, and jogged as described below. To this end, means for diverting the entering sheets of paper toward either horizontal pass through conveyor 46 or to vertical conveyor assembly 44 is provided. A pivotal deflector 42, driven by an entrance solenoid (not shown) is located near the entrance opening 35. In its normally biased and at rest position, as shown in FIG. 1, the pivotal deflector 42 is positioned out of the path of the oncoming sheets permitting the sheets to move toward a vertical conveyor assembly 44. By actuating the entrance solenoid, the first pivotal deflector 42 extends into the path of the oncoming sheets to urge the sheets onto the horizontal pass through conveyor 46. Guides 41 and 45 along the path of the sheets assure the proper orientation and direction of the sheets.

The pass-through conveyor apparatus 46 may be placed as shown across the top of sheet stacking apparatus 20, and comprises a wide belt 47 trained about rollers 40 and 43.

When the sheets are to be stacked onto the upper tray 82 or lower tray 84, the sheets pass diverter 42 to vertical conveyor 44 and then downwardly toward movable carriages which remove the sheets from conveyor 44. The vertical conveyor assembly 44 extends substantially across the width of the apparatus 20 and downwardly from near the sheet entrance 35 to near the base 26.

Vertical conveyor 44 has a top roller 50, a bottom roller 52, and a plurality of conveyor belts 56 through and around which air may pass. The top roller 50 and the bottom roller 52, are positioned to enable the conveyor belts 56 to be rotatably taut. Vertical conveyor 44 is driven by a drive mechanism such as an electric motor.

The vertical conveyor belts 56 preferably comprise a plurality of continuous, relatively flat, parallel, spaced-apart belts of porous, mesh-like, stretchable and flexible material. A mass airflow passes through and around belts 56 the to hold sheets during transport. The first roller 50 and second roller 52 have a means of maintaining the position of the spaced belts of the first conveyor belt assembly 54. This may be done by providing a crown at the location of each belt on the first and second rollers 50, 52, or by providing raised guides to restrict the sideways movement of each belt 56.

During the operation of the apparatus 20, the vertical conveyor belt assembly 44 is operated with the sheets of paper being held against the belts 56 by the dynamic movement of a mass airflow induced through conveyor vacuum plenum 61 by fan 63 which exhausts out the back wall 34.

Figure 2:
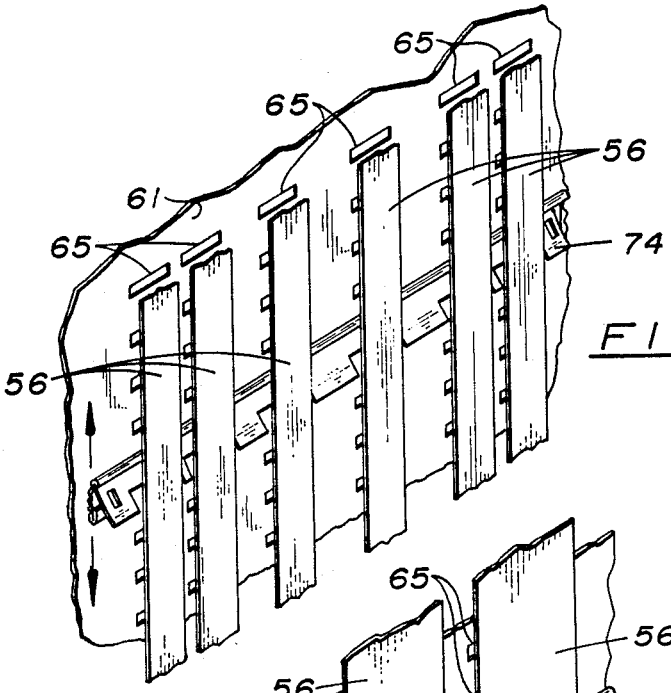
FIG. 2 is a partial perspective view of one wall of a conveyor belt assembly including a closed space or plenum held at a vacuum, wherein air flow slots are formed, a pivotal transfer deflector, and perforate or foraminous conveyor belts transversing the slots.
Figure 3:
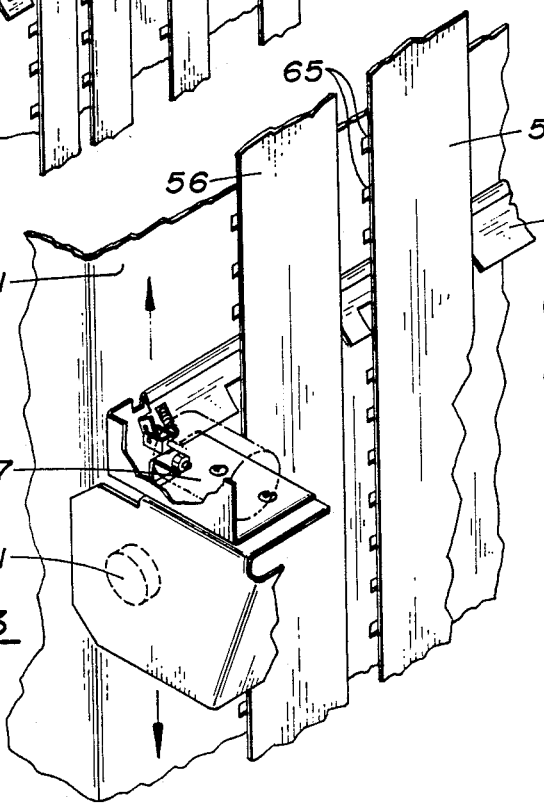
FIG. 3 is a partial perspective view of a movable transfer deflector used to deflect sheets from the vertical conveyor onto a movable carriage.

To obtain the mass airflow through the vertical conveyor belt assembly 44, the conveyor vacuum plenum 61, is interposed between the runs of belts 56 and is secured to the support frame 22. The conveyor chamber 61 has spaced-apart slots 65 located in rows directly behind each of the plurality of belts 56. The interaction between the conveyor vacuum plenum 61 and the belts 56 can be seen in FIGS. 2–4. Air in chamber 61 is removed by one or more high-volume, low-pressure differential fans 63, exhausting out the back of sheet stacker 20. The fans 63 may be conveniently mounted to the back wall 34 of the support frame 22. When operated, the fans 63 causes a mass airflow to be drawn through apertures 65 in the vertical conveyor vacuum plenum 61 which are located behind the vertical conveyor belts 56. The direction of the mass airflow is substantially normal to the vertical conveyor belts 56. The mass airflow holds the sheets against the belts 56, transporting the sheets along the vertical conveyor.

A guide roller 64 is used to assist the sheets in moving into engagement with the belts 56 on the vertical conveyor assembly 44. Roller 64 is located in close proximity to sheet guide 45 and is rotated by contact with moving belts 56. The sheets are passed between roller 64 and belts 56 onto the vertical conveyor assembly 44.

Located along the vertical conveyor assembly 44 are means for removing the sheet from the vertical conveyor assembly 44. Sheets are transferred from the vertical conveyor assembly 44 to one or more carriage assemblies associated with sheet stacking trays. Sheets traverse the carriage assemblies and are placed in a stack on the trays as is more fully described below.

Figure 7:
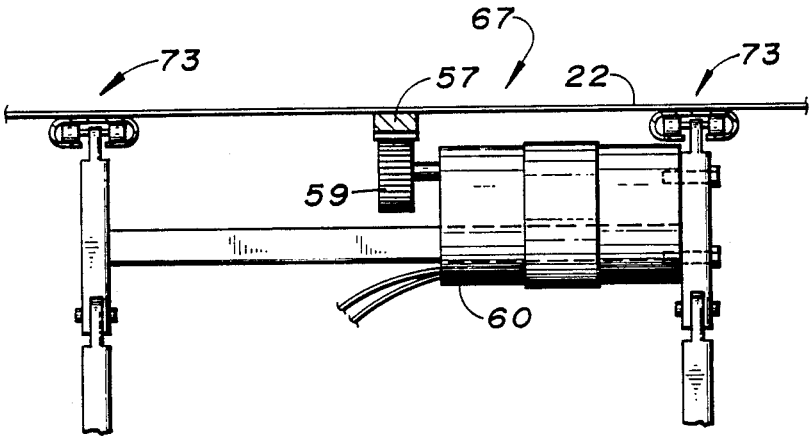
FIG. 7 is a partial plan view of the mechanism for raising g and lowering the movable sheet transfer carriage.

The upper carriage 70 and the lower carriage 72 are movably supported between the vertical conveyor 44 and a means 73 for supporting and tracking the carriage, which is located on the exit wall 32. The tracking means 73 is shown in FIG. 7. The tracking means 73 allows the first carriage 70 and the second carriage 72 to be independently and individually raised or lowered within the enclosure 24 in a generally vertical manner. A rack and pinion drive means 67 is used to raise and lower each carriage.

The upper carriage 70 and the lower carriage 72 extend at an inclined angle from the tracking means 73 upward towards the vertical conveyor assembly 44. Rollers 71 are provided to support the ends of the first and second carriages 70, 72, which rest against, and ride up and down, the surface of vertical 27 conveyor assembly 44.

A solenoid-driven, pivotal transfer deflector 74 is attached to the first carriage 70 in such a way as to be located between plenum 61 and belt 56. The location of transfer deflector 74 between the plenum 61 and belt 56 can be best seen in FIG. 2, 3, and 4. In its retracted position, the transfer deflector 74 does not interfere with the motion of the sheets along vertical conveyor assembly 44. This permits the sheets to pass by the upper carriage 70 and travel further down vertical conveyor assembly 44.

When solenoid 77 is activated, the transfer deflector 74 pivots away from plenum 61 to extend a portion of the transfer deflector 74 into the path of the sheets traveling down the vertical conveyor assembly 44. When so engaged, the transfer deflector 74 peels the sheets away from belt 56, and urges the sheets toward the upper tray or tote 82.

A stationary transfer deflector 76 is attached to lower carriage 72 in such a way as to be located between chamber 61 and belt 56. Portions of deflector 76 extend out between the g individual belts 54 of vertical conveyor assembly 44 to deflect the sheets toward the second tray 84. The stationary transfer deflector 76 peels the sheets away from belts 56 and urges the sheets toward the second tray or tote 84. The position of deflector 76 assures that the sheets do not pass below the lower carriage assembly 72.

If the sheets are directed toward upper tray or tote 82 by the deflector 74, the upper carriage 70 receives the sheets and transfers the sheets across toward upper tray 82. If deflector 74 is not extended and the sheets travel past it, the sheets will be deflected onto lower carriage 72 by stationary transfer deflector 76. Lower carriage 72 then receives the sheets and transfers the sheets across toward lower tray 84.

The first tray 82 and second tray 84 are preferably identical and are designed to be removable, each having the capacity to support large quantities of stacked sheets. When the first tray 82 is full, the first carriage 70 is raised sufficiently to allow the upper tray 82 to be pulled from below the first carriage 70. Likewise, the second carriage 72 may be raised sufficiently to allow the removal and replacement of the second tray 84. The first and second trays 82, 84, may be placed upon drawer-type slides 83 to facilitate easy removal and replacement of the trays within the enclosure 24. The removable first tray 82 and second tray 84, may also be referred to as the first and second tote, respectively. Where two trays or totes are used, this apparatus may be referred to as a "dual-tote" system.

In the preferred embodiment, the upper and lower trays and their respective carriages are identical and interchangeable with the exception of the deflector structure discussed above. A passive jogging system is used which causes the sheets to be stacked at an angle from horizontal. This is accomplished by placing sheet receiving surface 88 at an angle from horizontal. As the sheets are deposited, gravity, or the momentum of the sheets, causes the sheets to slide down the inclined sheet receiving surface 88 and become aligned against a first backstop wall 92 of tray 82. The backstop wall 92 is perpendicular and adjacent to receiving surface 88 retaining wall 92 is preferably formed as an integral part of the tray 82.

Figure 8:
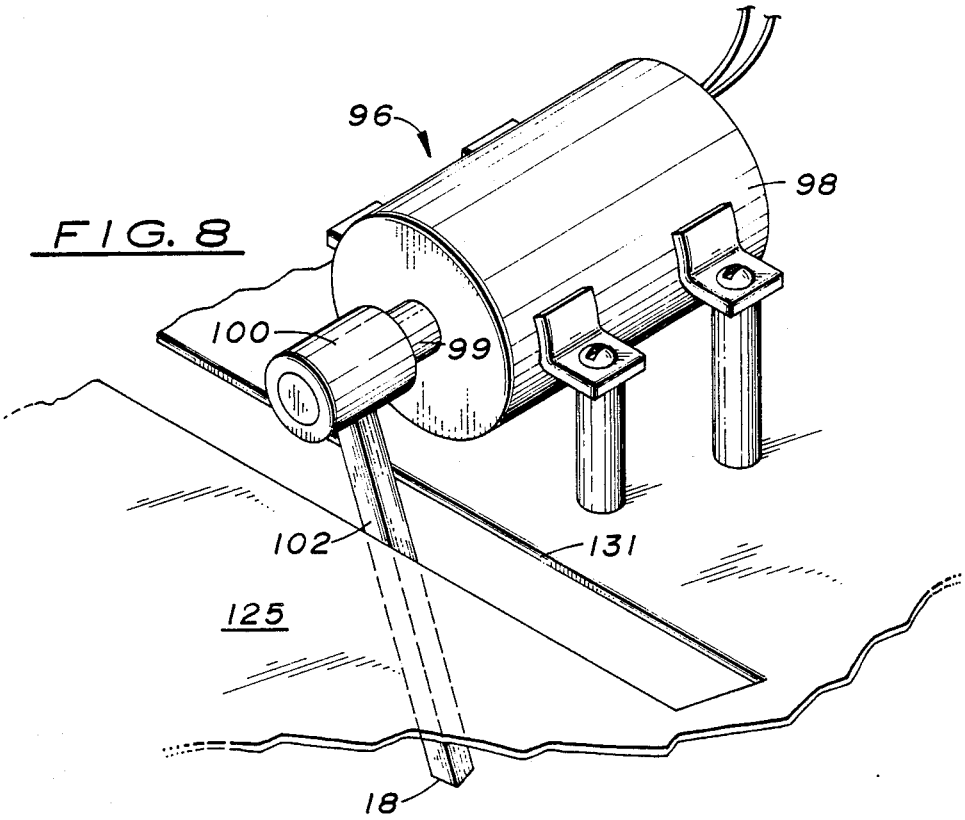
FIG. 8 is a perspective view of a jogging apparatus made in accordance with this invention.

As the sheets are deposited into tray 82, a means of jogging the sheets into aligned job stacks is engaged. The jogging means acts perpendicular to the direction of sheet travel and comprises a rotating jogging apparatus 96 associated with each tray and carriage. The locations of the jogging apparatus are shown in FIG. 1, while an enlarged detailed perspective view is shown in FIG. 8.

The jogging apparatus 96 comprises: jogging motor 98, motor shaft 99, chuck 100, and flexible jogging finger 102. The chuck 100 is secured to motor shaft 99 of jogging motor 98. Elongated flexible jogging finger 102 is removably secured to chuck 100. Jogging motor 98 does not continually rotate; rather, it rotates one complete turn each time a sheet is fed onto the stack and then is disengaged to await the deposit of the next sheet into the tray 82. Since the jogging finger 102 is not rotating continuously, wear of the jogging finger 102 is greatly reduced and the chance of smearing the printing on a sheet is lessened.

When jogging motor 98 is rotated, jogging finger 102 presses lightly against the top sheet and moves it against side 104 of tote 82. The action of jogging finger 102 moves the top sheet while holding the top sheet lightly against the top of the stack. Jogging finger 102 continues to rotate, passing across the top sheet, and sliding or jogging the top sheet into a registered position against the side wall 104. The registered position depends upon the rotational direction of the first jogging motor 98 and the position of the side wall of the tray against which the sheet comes to rest. The next lower sheet remains quiescent.

Jogging finger 102 may have any convenient cross-sectional shape and may be tapered. The preferred embodiment uses a jogging finger in the shape of a triangular prism. Jogging finger 102 is constructed of polyurethane having a durometer hardness of about 60. Other suitable material which will gently move the top sheet of a stack may be used. Jogging finger 102 is preferably between two and six inches in length, very flexible and has a tacky or "sticky" quality toward paper.

Figure 5:
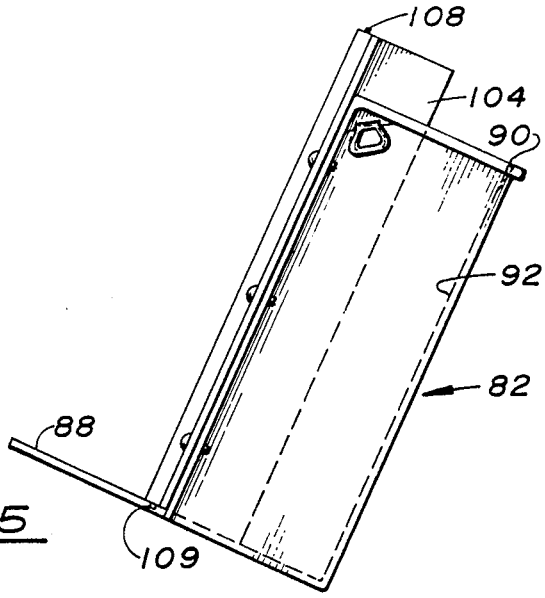
FIG. 5 is a side elevational view of a tray or tote made in accordance with this invention.
Figure 6A:
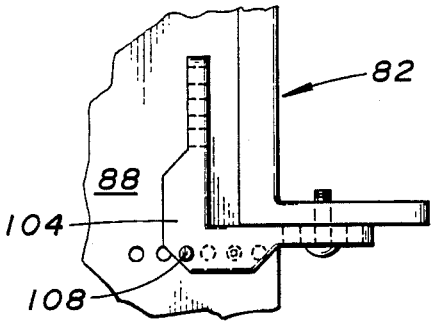
FIG. 6*a* is a fragmentary plan view of the tray shown in FIGS. 5 and 6.
Figure 6:
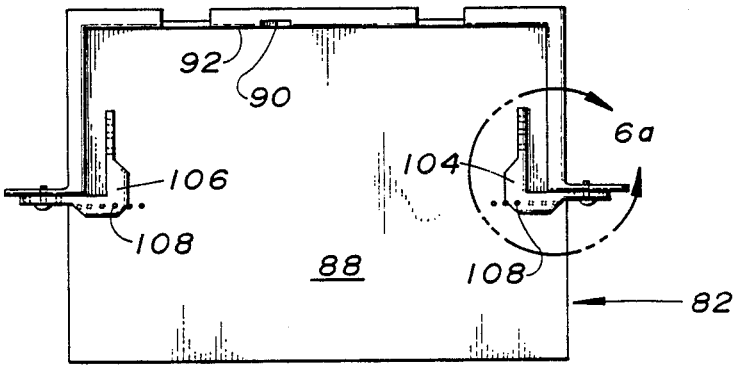
FIG. 6 is a plan view of the tray or tote shown in FIG. 5.

In the preferred embodiment, tray 82 has side walls 104 which are adjusable for different sheet sizes. The manner in which side wall 104 may be adjusted is illustrated in FIGS. 5, 6 and **6*a*. Using the multiple and offset mounting holes drilled into both sides of the first and second side walls 104, 106, the side walls may be positioned in a plurality of positions. This permits the apparatus 20 to sort and stack a variety of differently sized sheets of paper. Stationary pegs 108 and 109 may be used to index in the adjustment holes shown, the movement of the first or second side wall 104, 106 at the desired width locations. By inverting and switching the positions of side walls 104 and 106** additional variation in the width of the tray can be achieved.

Figure 14:
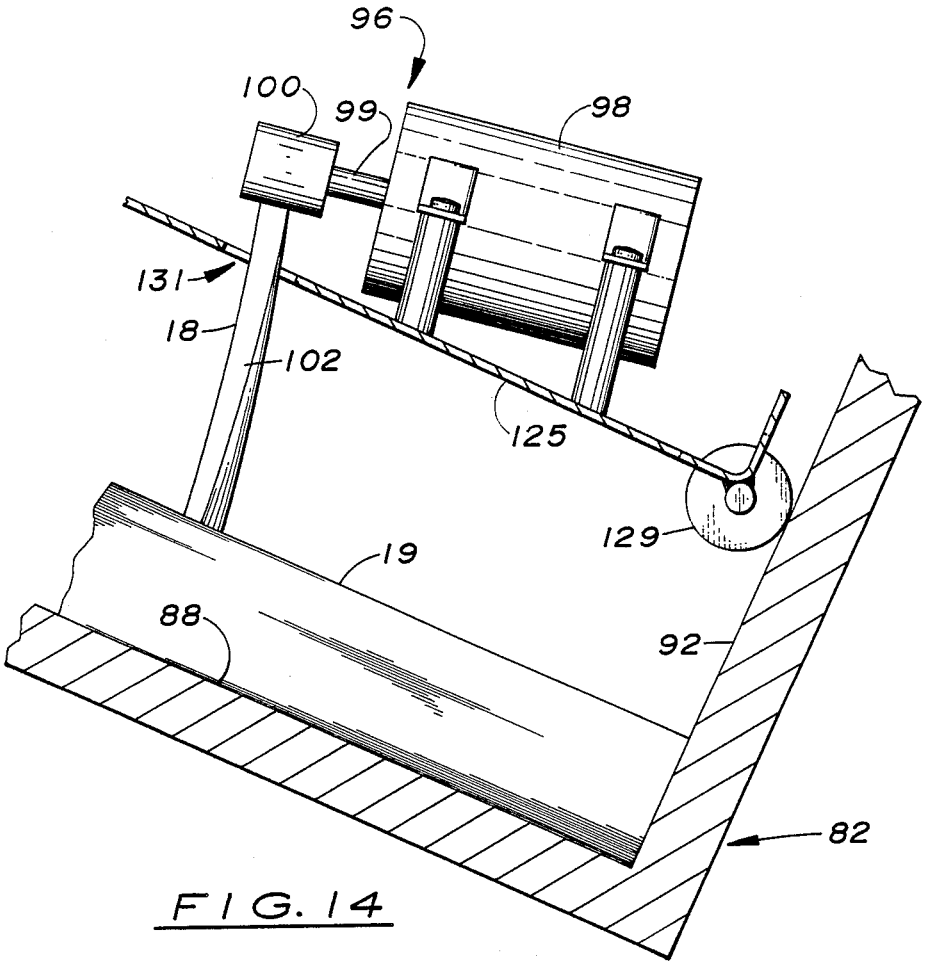
FIG. 14 ia side elevational view of the jogging mechanism using a triangular prism flexible jogging finger showing multi directional jogging achieved by the apparatus made in accordance with this invention.

As may best be seen in FIG. 14, jogging motor 98 is preferably positioned so that the jogging finger 102 not only forces the sheet 19 against the first or second side wall 104, 106, depending upon the direction of rotation, but also snugly against the backstop wall 92. This may be done by appropriately securing jogging motor 98 to carriage 70 so that the rotational axis of motor shaft 99 is non-parallel to the first receiving surface 88 as is seen in FIGS. 1 and 8. Jogging finger 102 is preferably shaped as an elongated triangular prism with one apex facing the incoming sheets. When jogging finger 102 contacts the surface of the sheet, its unique movement of pivoting and bending forces the sheet against both the backstop wall 92 and either first side wall 104 or second side wall 106. By using this device and method, one jogging motor can be used to jog in two directions. Jogging finger 102 assures the proper alignment of the sheets within tray 82, and it corrects any rebounding effect which may occur when the sheets hit backstop wall 92. Paper bails 188, positioned adjacent each side wall 104, 106 depend from carriage assembly and rest lightly on the sheet upper surface to resist further movement and decrease or eliminate the effects of sheet curl on the stacking procedure.

The distance between the first side wall 104 and second side wall 106 is somewhat greater than the length of the sheets, then by reversing the rotational direction of the jogging motor 98 after each job has been stacked, alternating jobs will align against opposed side walls with the varying alignment of the successive stacks easily identifying each job stack.

One jogging mechanism as described above is used with each tote and its associated carriage.

The jogging fingers 102 are preferably located over the approximate center of each corresponding stack so that equivalent forces are applied to the top sheet in both rotational directions used to jog the sheets.

If tray 82 is not inclined, dual jogging devices may be provided for each tray on non coincident axes so that the jogger may urge the sheet positively against the side walls and the backstop, or in some instances against a secondary backstop wall placed opposite the backstop wall whereby additional offsets may be programmed into the apparatus for additional differentiation among jobs.

Trays 82 and 84 are mounted on the stacker frame with the respective receiving surfaces 88 angled from horizontal. As sheets are stacked, the top of the stack of sheets progressively moves upwardly and away from vertical conveyor assembly 44. For the sheets to be properly deposited by gravity into trays 82 and 84, carriages 70 and 72 must necessarily be at a higher elevation than the top of the stack of sheets stored in that corresponding tray. It is undesirable, however, to have the carriage located at an excessive height above the top of the corresponding stack of sheets. Therefore, carriage 70 is preferably positioned in close proximity to the top of the stack of sheets in trays 82, and moves upwardly as the height of the stack increases. A limit switch 132 operated by the increasing height of the stack activates motor drive 60 to move the carriage up or down depending upon the height of the stack of sheets.

Transfer deflector 74 is attached to the end of carriage 70 and is raised along with the upper carriage 70. The stationary transfer deflector 76 is carried by and raised along with lower carriage 72. As the upper tray 82 or lower tray 84 is emptied and replaced, the corresponding carriage and transfer deflector is returned to its lower operative position.

The inclined positioning of upper tray 82 and lower tray 84, and the raising and lowering of their respective carriages do not significantly affect the operation of the joggers 96. The distance between jogging finger 102 and backstop wall 92 remains the same as carriage 70 is being raised and the height of the stack is increasing. To achieve these ends, carriage assembly 70 is provided with a means for extending the length of the carriage.

Figure 9:
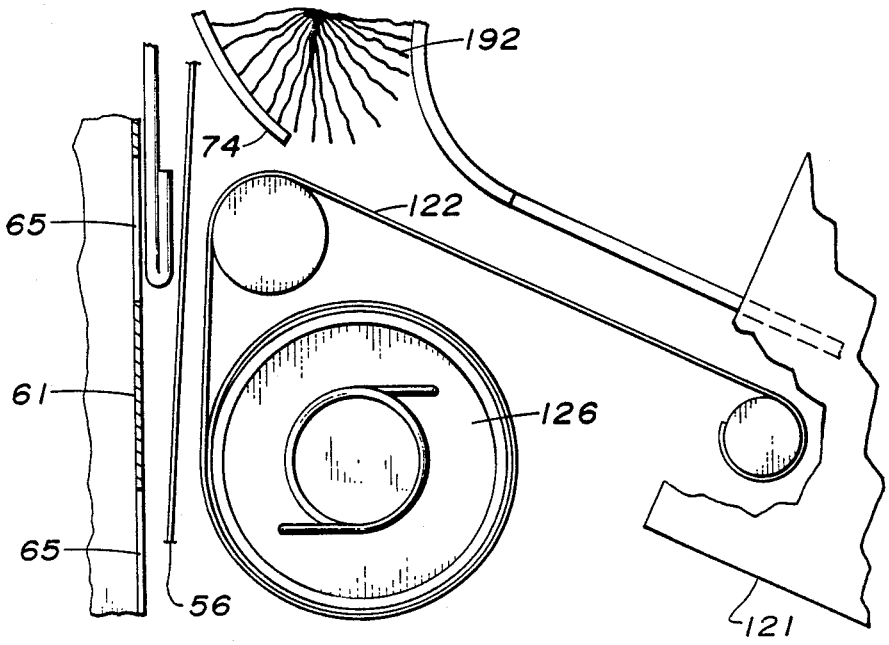
FIG. 9 is a partial, side elevational view of an extension means used with the sheet transfer carriage.
Figure 10:
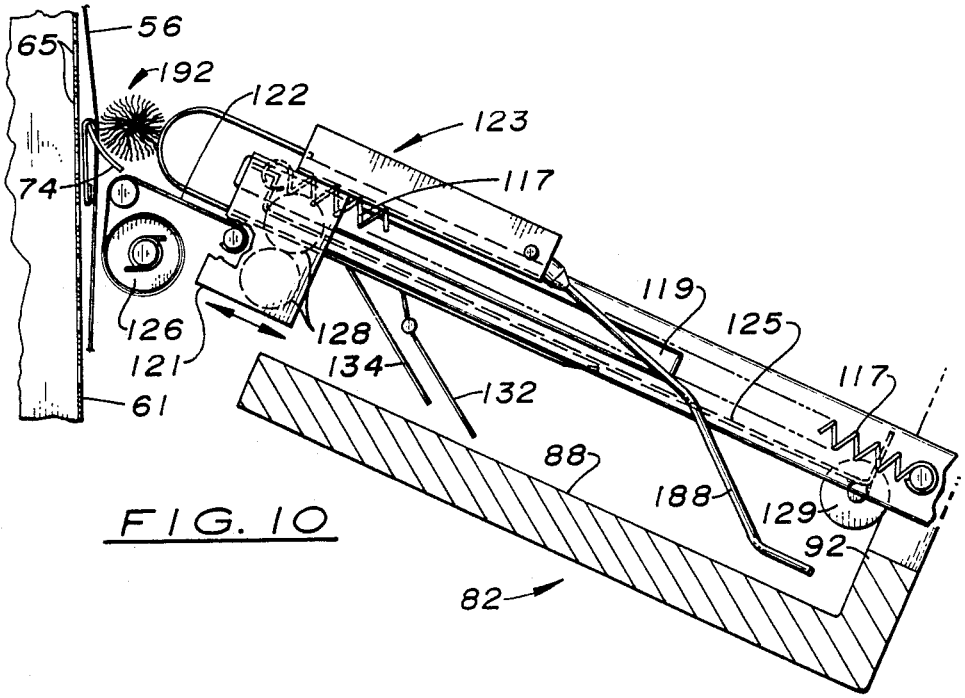
FIG. 10 is a partial, side elevational view of the sheet transfer carriage, pivotal transfer deflector, extension means, and powered punch rollers.

Extension means 123 is slidably mounted in slot 119 upon carriage 70. As carriage 70 is raised, expansion means 123 is urged toward backstop wall 92. FIGS. 1, 9 and 10, show the extension means used in the preferred embodiment. Shuttle 121 rides in slot 119 and is spring-biased by spring 117 toward backstop wall 92. Platform 125 extends from shuttle 121 to roller 129 which abuts backstop wall 92 thereby maintaining the distance between backstop wall 92 and shuttle 121 constant as carriage 70 moves up and down. Jogging apparatus 96 is secured to platform 125 and a slot 131 is provided therein to enable jogging finger 102 to rotate into contact with and pass across the top sheet in tray 82, thereby jogging the top sheet against one of the side walls 104, 106 of tray 82.

To accommodate the movement of shuttle 121 along carriage 70, the length of sheet support surface 122 which spans the variable distance between transfer deflector 74 and discharge rollers 128 can be increased or decreased. A flexible sheet support surface 122 is fixed at one end to shuttle 121 and is trained about roller 129 to take up roller 126. The sheet is preferably made of a smooth flat flexible material such as MYLAR brand polyester film manufactured by E. I. DuPont de Nemours Inc., Wilmington, Del. or its equivalent. Take up roller 126 is rotatively spring tensioned so that sheet support surface 122 may be extended or retracted to span the variable distance between vertical conveyor assembly 44 and drive discharge rollers 128.

The time required to deposit the sheets within the first tray 82 directly corresponds to the length of the sheet support surface in carriage 70. As the length of carriage 70 increases, the sheet must travel a longer distance and be exposed to a longer sheet support surface. To ensure that all of the sheets traveling across conveyor 70 into tray 82 enter at the same speed, a set of powered pinch rollers 128 are provided. Powered pinch rollers 128 are illustrated in FIG. 1 and 10. Powered pinch rollers 128 are secured to shuttle 121 and are positioned near the upper edge of the sheet stack. All sheets passing along the sheet support surface 122 of carriage assembly 70 are propelled by pinch rollers 128 into tray 82 at a regulated speed so that rebound from backstop wall 92 can be controlled or eliminated.

A limit switch which reads the height of the stack of sheets within tray 82, is attached to the underside of carriage 70. Limit switch arm 332 depends from the limit switch and rests lightly on the top of the stack of sheets. A first deflector strip 134 may be placed near the first limit switch 132 to prevent the sheets from becoming jammed against the first limit switch arm 132 and aid in sliding the sheets beneath the limit switch arm 132. As the stack of sheets grows, limit switch arm 132 raises and at a predetermined level activates the limit switch causing the carriage 70 to be raised or lowered by rotation of pinion 59 engaged in rack 57. If a time delay is built into the activation of the first limit switch 132, the incoming sheets come to rest against the first retaining wall 92 before the first limit switch 132 is activated. The limit switch arm 132 may also serves to help prevent the sheets from rebounding away from backstop wall 92.

Sheet hold down bar 188 may also be used to help prevent the sheets from rebounding away from backstop wall 92, to combat curl and to help the sheets in the stacks to maintain their jogged alignment.

Static discharge strip 192 may advantageously be used with this invention to aid in removal of static electrical charges generated on the sheets. In the preferred embodiment, a static discharge strip 192 is a strip of tinsel which is stretched across the width of each carriage and grounded to the frame of the stacking mechanism. A static discharge strip 192 may be located on carriage 70 near transfer deflector 74 or in any other convenient location along the path traversed by the sheets. The static discharge strip 192 should lightly touch the sheets as they are moving toward the trays.

The limit switches, hold down bars, and static discharge strips are generally illustrated in FIGS. 1 and 10.

Figure 11:
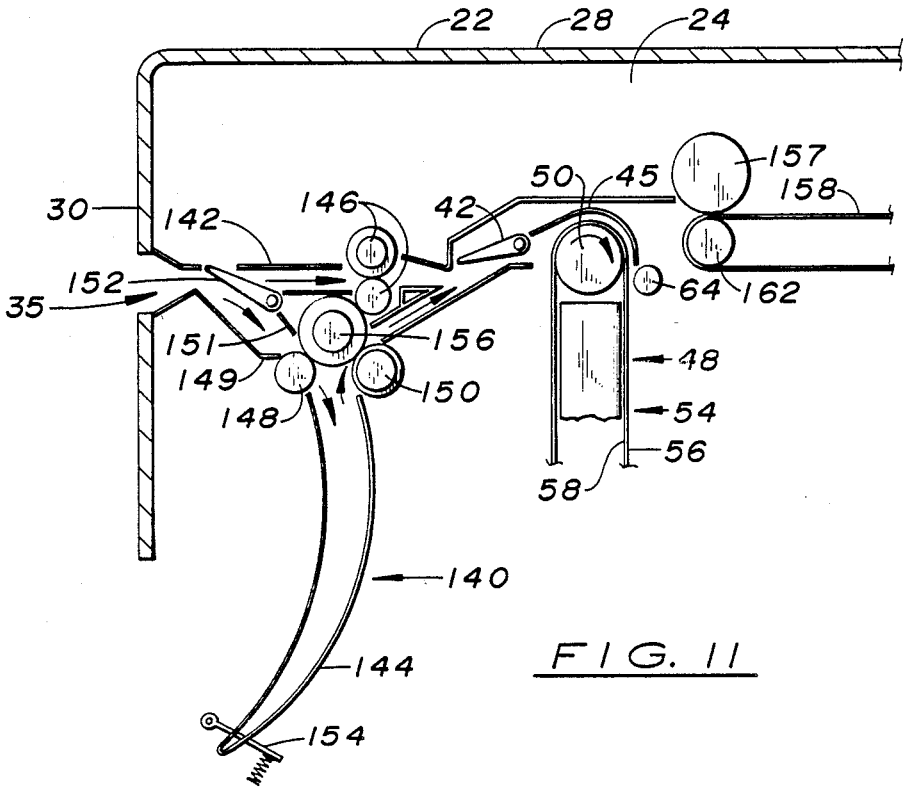
FIG. 11 is a schematic, partial, side elevational view of the flipper apparatus made in accordance with this invention.
Figure 12:
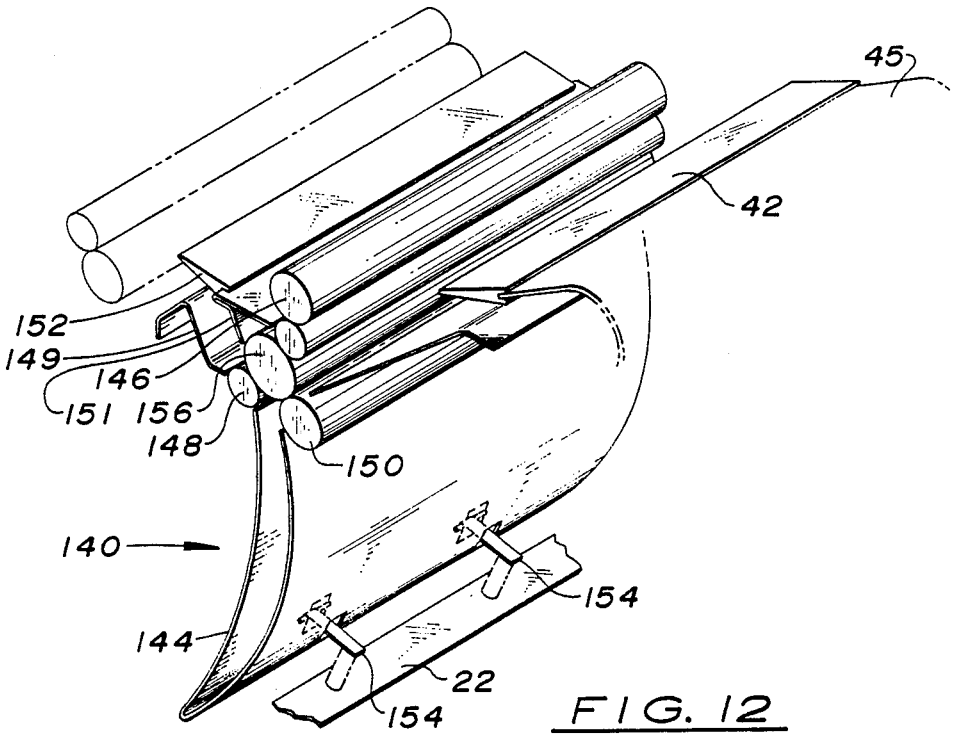
FIG. 12 is a perspective view of the flipper apparatus made in accordance with this invention.

Sheets of paper exiting printers or photocopying machines often need to be flipped so the sheet surface which otherwise would be facing upward within the stack is reversed to face downward within the stack or vice-versa. To enable this invention to accomplish such a task, a flipper apparatus 140 shown in FIGS. 11 and 12, which is capable of selectively flipping the sheets as they enter the enclosure 24, may be used. FIG. 11 and 12 illustrate the flipper apparatus 140. The flipper apparatus 140 is located near the entrance opening 35 of the entrance wall 30, and comprises: a deflector 152, a rebound tray 144, sets of pinch rollers 146, 148, 150, and return spring 154 The dimensions of the flipper apparatus 140 should allow the insertion of a variety of differently sized sheets. The flipper apparatus may also be located outside the enclosure with its discharge placed at the entrance to the stacker mechanism.

As the sheets are inserted, deflector 152 directs the entering sheets toward either pinch rollers 146, or 156. In one position, deflector 152 permits the sheets to proceed through pinch rollers 146 and on into the stacking mechanism without flipping.

In its other position, deflector 152 extends into the path of the oncoming sheets and urges the sheets toward nip of rollers 148 and 156. Acting concurrently with deflector 152, sheet guides 149 and 151 assures entry of the sheets into the nip of rollers 148 and 156.

When the sheets are intercepted and directed through the nip of rollers 148 and 156, the sheets are driven at a set velocity into rebound tray 144. As sheets reach the bottom of rebound tray 144 a return spring 154 is deflected, and the momentum of the sheet is absorbed and reimparted to the sheet, now moving in the opposite direction. Spring 154 and pinch roller 156 urge the sheets upward into the nip of rollers 150 and 156, which drive the sheets toward deflector 42. This method, of requiring the sheets to enter, reverse direction and exit the rebound tray 144, causes the sheets to be flipped. It is advantageous to use only three rollers, 148, 150 and 156 to form the two nips used as shown in FIG. 11. By positioning the pinch rollers as shown, the trailing edge of the sheet may remain in contact with the center roller 156, the return spring 154 and the center roller 156 act jointly to urge the trailing edge of the sheet into the nip of rollers 150 and 156. Various sheet sizes can be accommodated when the flipper apparatus 140 is constructed as shown in Figs. 11 and 12. Rollers 146, 148, 150 can all be driven by driving any one individual roller. After being directed toward deflector 42 the sheets move as discussed above toward either the pass through conveyor 46 or the vertical conveyor 44.

The pass-through conveyor apparatus 46 shown in FIG. be automatically engaged where both the first and second trays 82, 84 are full or if it is desired to send sheets to an adjacent sheet handling device. By using both the pass-through conveyor apparatus 46 and the flipper apparatus 140, the sheets may be flipped and ejected from the apparatus 20 without being stacked into the trays.

Figure 13:
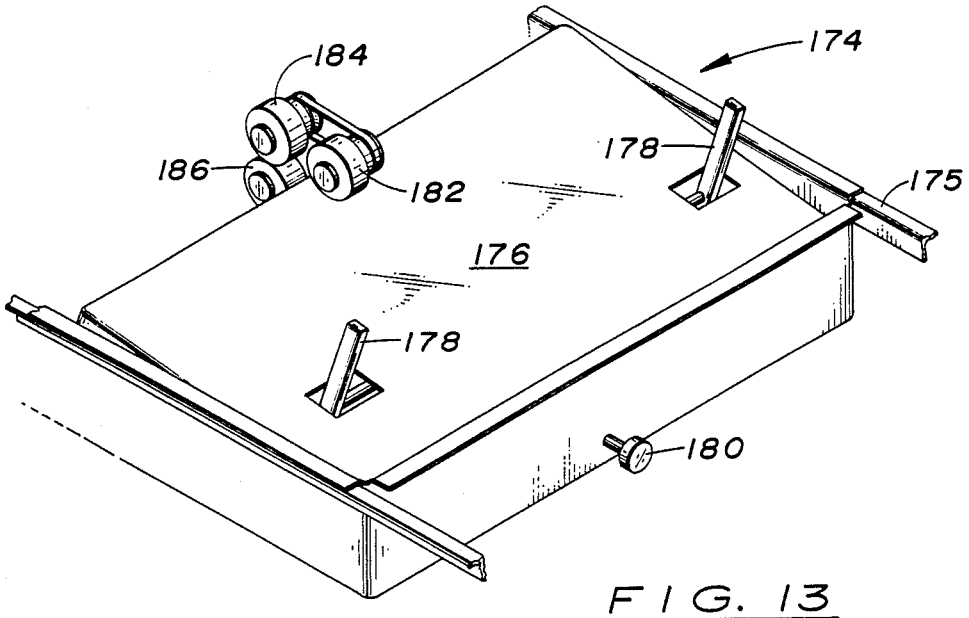
FIG. 13 is a perspective view of the slip-sheet feeder apparatus made in accordance with this invention.

Removal of the pass-through conveyor apparatus 46 from within the enclosure 24 allows the placement of a slip-sheet feeder apparatus 174 in its stead. The slip-sheet feeder apparatus 174 is illustrated in FIG. 13. The slip-sheet feeder apparatus 174 removes individual sheets of paper from an original stack and feeds them into the apparatus 20. The slip-sheet feeder apparatus 174 comprises: a framework 175, a spring-loaded table 176, paper width stops 178, a paper size-adjustment means 180, a first feed roller 182, a second feed roller 184, and a non-powered retard roller 186.

A spring-loaded table 176 is pivotally secured to the framework 175 in such a manner as to force the leading edges of the sheets against the first feed roller 182. Attached to the framework 175, beneath the spring-loaded table 176, is a means for adjusting the size of the spring-loaded table 176 to accommodate different sizes of paper sheets. A functional part of the size-adjustment means 180 are the paper width stops 178. When the size-adjustment means 180 is adjusted, the distance between the paper width stops 178 may be widened or narrowed, thereby, changing the width of the usable table surface of the spring-loaded table 176.

A stack of paper sheets is loaded onto the pivoting spring-loaded table 176. The paper width stops 178 are appropriately adjusted with the paper size-adjustment means 180. The leading edge of the top sheet of the original stack is urged against the first feed roller 182 by the spring-loaded table 176. The slip-sheet feeder apparatus 174 is secured to the support frame 22 within the enclosure 24 so that the second feed roller 184 and the retard roller 186 are in close proximity to the first pinch roller 64. Suitable paper guide framing used to assure that the sheets are properly directed from the slip-sheet feeder apparatus 174 to between the first outer run of conveyor belts 56 and the first pinch roller 64.

The spring-loaded table 176 presses the top leading edge of the stack of sheets up against the first feed roller 182, which is located at approximately the centerline of the stack. Rotation of the first feed roller 182 pulls the top sheets off of the stack and feeds them toward the second feed roller 184 and the retard roller 186. The distance between the second feeder roller 184 and the retarding roller 186 is only sufficient to allow a single sheet to pass between them. The second feeder roller 184 rotates to pull the very top sheet off of those sheets fed to it and feeds that sheet between the first outer run of conveyor belts of conveyor belts 56 and the first pinch roller 64, toward the second path. As the single sheet leaves the slip-sheet feeder 27 apparatus 174, it is accelerated onto vertical conveyor 44 by the first pinch roller 64 located near the top of vertical conveyor assembly 44. The sheets may then be sorted, jogged and stacked in either the upper tray 82 or lower tray 84. The retarding roller 186 prevents the lower sheets from being fed into the apparatus 20 by the second feeding roller 184. The distance between the second feed roller 184 and the retarding roller 186 may be easily adjusted with an adjustment means.

Sensors are located throughout the apparatus 20 to detect if any jamming of the sheets has occurred, whereupon the affected portions of the apparatus 20 are disengaged and warning mechanisms are engaged.

Figure 4:
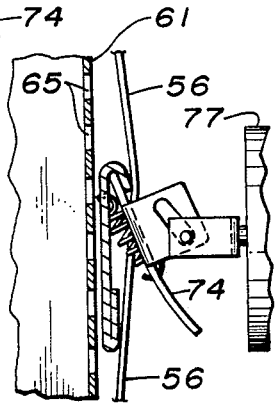
FIG. 4 is a partial, side elevational view of the pivotal transfer deflector shown in FIGS. 2 and 3.

In operation the dual tote sheet stacking mechanism described above in its preferred embodiment is utilized to stack sheets such as paper emanating from a sheet feeding source such a printer, a copy machine or other source of individually fed sheets. The sheets enter the sorting device at entrance 35 and immediately encounter a deflector mechanism 42 which either intercepts the sheets and passes them on to a pass through conveyor 46, or permits the sheets to enter the sorting and stacking region of the apparatus by entry onto vertical conveyor 44. The vertical conveyor 44 utilizes the volume air flow concepts taught in the commonly assigned U.S. Patent issued to Greene mentioned above and is used to transport the sheets downwardly into sheet stacking trays. The volume air flow apparatus which comprises a vacuum plenum 61 having a plurality of perforations for aperture 65 in the face thereof. Since the air pressure inside plenum 61 is less than the atmospheric air pressure and the air is induced by fans 63, the sheets are held against belts 56 which causes the sheet to move downwardly along the vertical conveyor 44. As the sheet approaches the upper carriage 70, the deflector mechanism 74 is either in a position in which it intercepts the sheet causing the sheet to enter onto upper carriage 70 or the sheet is permitted to pass by the deflector to the lower carriage. A permanently extended or fixed deflector 76 extends into the path of the sheet at the lower carriage insuring the sheets are removed from the vertical conveyor 44. If deflector 74 is extended into the paper intercepting position as is shown in FIG. 4, the sheet will be deflected onto upper carriage 70 and traverse across sheet support 122 toward tray or tote 82. A pair of driven nip rollers 128 engage the sheet and regulate the speed of the sheet in its travel toward tray 82. The sheet is discharged from the nip of rollers 128 and permitted to settle downward sheet receiving surface 88 of tray 82 or upon the top sheet in the newly formed stack of sheets, entering into the angled tray 82 until the sheet abuts the backstop 92. At that point the travel of the sheet is arrested and it settles upon the stack of sheets being formed. Carriage 70 is moveable vertically to insure that the point of discharge from rollers 128 is located properly to stack the sheets as desired. A limit switch operated by limit switch arm 132 senses the level of the top most sheet in the stack being formed and at preset heights of the stack of sheets causes the carriage 70 to be raised and lowered by activating pinion 59 on rack 57. The carriage assembly 70 may be raised or lowered in response to the height of the stacks sensed by limit switch arm 132. When tray 82 is filled to the desired level, carriage 70 is raised to its upper most position above the top of tray or tote 82 permitting the tray or tote 82 to be drawn out of the cabinet on slides 83 and removed for further processing elsewhere. The roller 129 rides upon the inner surface of backstop 92 and at the upper most travel of carriage 70 engages cam surface 90. The inner engagement of roller 129 and cam 90 permits the indexing of shuttle 121 with respect to the stack of sheets, yet permits the carriage 70 to roll up and out of bin 82 yet permits smooth reentry into bin 82.

During stacking of the sheets it is desirable to job stack, i.e. individually separated stacks of sheet which may be differentiated from adjacent jobs. This may be accomplished by utilizing a jogger finger 102 rotating first in one direction for a series of sheets defining the first job whereby the sheets are jogged into alignment against one of the sidewalls of tray 82 and upon completion of that job the direction of rotation of jogger finger 102 is reversed so that sheets are gently jogged against the opposed sidewall of tray 82. The result is a series of staggered stacks of sheets which may be readily observed and separated once the tray 82 is removed.

INDUSTRIAL APPLICABILITY

This invention is particularly adapted for the uninterrupted stacking of large quantities of sheets of paper as are often needed for the effective use of large mainframe or coxxercial printing and duplicating equipment. Provision is made for selectively flipping or inverting of sheets and a jogging means to align the stacked sheets and separate the stacked sheets into individual job stacks.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the legitimate and valid scope of the appended claims, appropriately interpreted in accordance with the doctrine of equivalents.

We claim:

1. An apparatus for receiving, transporting, and stacking sheets into stacks comprising the combination of:

(a) a support frame defining an enclosure, said enclosure having sheet receiving means for entry of said sheet into said enclosure;

(b) vertical conveyor means extending along one wall of said enclosure; said vertical conveyor having a plurality of foraminous belts through which air is drawn into a vacuum plenum, a wall of said vacuum plenum supporting said belts for movement thereon, said belts being trained about upper and lower rollers;

(c) means for conducting said sheets from said receiving means to said vertical conveyor;

(d) means for removing said sheets from said vertical conveyor and placing said sheets in a stack on a support surface, said means for removing comprising a carriage assembly abutting said vertical conveyor and having means to raise and lower said carriage assembly engaging said frame, said means for removing having a transfer deflector attached in said carriage, said transfer deflector being located between said vacuum plenum and said foraminous belts, and extendable into the path of sheets travelling along said vertical conveyor to deflect said sheets onto said carriage assembly, further comprising means to deliver sheets to an inclined tray and an extendable and retractable sheet transfer support surface over which said sheets move from said vertical conveyor to said tray;

(e) an inclined tray assembly, said tray assembly having an inclined tray removably attached to said support frame and being located near the end of said extendable and retractable sheet transfer surface, said tray receiving sheets from said carriage, the vertical location of said carriage indexing with the height of the stack of said sheets within said tray.

2. The apparatus of claim 1, having an upper and lower removable tray, each tray having a means for removing sheets from said vertical conveyor associated therewith.

3. The apparatus of claim 1, wherein said continuous belts are made of a mesh-like, flexible material.

4. The apparatus of claim 2, wherein said transfer deflector 3 associated with said upper tray is pivotally mounted for 4 extension into a first position in the path of sheets carried by 5 said vertical conveyor or into a second retracted position permitting the sheets to pass to the lower removable tray.

5. The apparatus of claim 1, wherein said paper receiving surface is canted upwardly toward said vertical conveyor causing said sheets in said tray to be stacked at an angle from horizontal, whereby entering sheets are jogged by gravity against the back of said tray into a neat stack.

6. The apparatus of claim 1, wherein said carriage means further includes driven rollers between which said sheets pass to impart a preselected velocity to said sheets whereby consistent stacking occurs, said driven rollers being located near the upper edge of said stack and maintained at a fixed distance therefrom as the stack height increases.

7. The apparatus of claim 1, further comprising a means for jogging said sheets on said tray perpendicular to the path of sheet travel said tray having a sheet receiving surface, a g backstop wall, and first and second side walls, said backstop wall being substantially perpendicular to said sheet receiving surface and to said first and second side walls, said jogging means comprising an elongated, flexible jogging finger mounted for rotation into contact with the upper surface of a sheet deposited upon said tray in a wiping movement, thereby moving only a single sheet on the top of the stack of said sheets located within said tray against said first or second side wall depending upon the direction of rotation, whereby the next lower sheet remains quiescent thereby separating said stack of sheets into separate sets.

8. The apparatus of claim 7, wherein said flexible jogging finger is comprised of polyurethane with a durometer hardness of about 60.

9. The apparatus of claim 7, wherein said flexible jogging finger has a substantially triangular prismatic shape.

10. The apparatus of claim 7, wherein said flexible jogging finger rotates about an axis angled with respect to the upper surface of said tray, whereby sheets are jogged both toward said side wall and said backstop wall as said jogger finger rotates.

11. The apparatus of claim 7, wherein said flexible jogging finger is shaped substantially as an elongated triangular prism, one flat surface of which is positioned substantially parallel to said backstop.

12. The apparatus of claim 11, wherein said first flexible jogging finger is capable of reversing its rotational direction after each job stack has been obtained.

13. The apparatus of claim 1, further including a sheet flipper assembly, said flipper assembly being positioned at said sheet receiving means and being capable of selectively inverting said sheets before said sheets reach said vertical conveyor.

14. The apparatus of claim 12, wherein said flipper apparatus includes diverter means for allowing said sheets to pass through or enter into said flipper apparatus, said flipper apparatus having an arcuate rebound tray, a rebound spring means and entrance and exit sheet path means whereby the trailing edge of a sheet entering said arcuate rebound tray becomes the leading edge and momentum of said sheet is transferred in direction by said rebound spring to urge said sheet into said exit path.

15. The apparatus of claims 1, further comprising a slip sheet feeder assembly, said slip sheet feeder assembly feeding said sheets towards said vertical conveyor.

16. The apparatus of claim 1, further comprising a pass-through conveyor apparatus, said pass through conveyor apparatus having a continuous second conveyor belt, and a third roller and a fourth roller enabling said second conveyor belt to be rotatably taut, said second conveyor belt assembly being horizontally oriented and having a second outer run, said first pivotal deflector being capable of deflecting said sheets along said first path towards said second outer run, said second conveyor belt transporting said sheets outward from said apparatus.

* * * * *